US005842854A

United States Patent [19]

Willms et al.

[11] Patent Number: 5,842,854

[45] Date of Patent: Dec. 1, 1998

[54] INFRARED HEATING SYSTEM AND METERING ELEMENT

[76] Inventors: Eric Willms, R.R. #1, Georgetown, Ontario, Canada, L7G 4S4; Pat Caruso, 56 Durham Rd., Stoney Creek, Ontario, Canada, L8E 1X3

[21] Appl. No.: 634,657

[22] Filed: Apr. 18, 1996

[51] Int. Cl.[6] ..... F23D 14/62

[52] U.S. Cl. ..... 432/147; 432/146; 432/209; 431/354

[58] Field of Search ..... 432/146, 147, 432/148, 209, 175; 431/91, 126, 350, 351, 354

[56] References Cited

U.S. PATENT DOCUMENTS 2,751,893 6/1956 Permann ..... 432/175
4,243,176 1/1981 Hays ..... 431/354
4,856,981 8/1989 Flanagan ..... 431/1
5,154,598 10/1992 Gooderham et al. ..... 431/354
5,211,331 5/1993 Seel .
5,353,986 10/1994 Wortman et al. ..... 237/2 R
5,361,750 11/1994 Seel et al. .

*Primary Examiner*—Teresa J. Walberg
*Assistant Examiner*—Gregory A. Wilson

[57] ABSTRACT

A radiant heating system 30 comprising a tube 34 for radiating heat having a vacuum pump 40 coupled to an upstream end 35 for introducing negative pressure therein, a plurality of burner assemblies 32 mounted in series along a length thereof for igniting a combustible gas within the tube 34, and a metering element 90 for controlling the firing rate of the burner assemblies 32 under variable negative pressure conditions.

29 Claims, 4 Drawing Sheets

O.G. FIG.
CLASS SUBCLASS

INFRARED HEATING SYSTEM AND METERING ELEMENT

TECHNICAL FIELD

This invention relates to the art of heating.

More particularly, the present invention relates to a radiant heating system for heating an area.

In a further and more specific aspect, the present invention concerns a metering element for use in combination with a radiant heating system of the infrared variety.

BACKGROUND ART

Heating concerns the process of raising the temperature of an enclosed space for the primary purpose of ensuring the comfort of the occupants. By regulating the ambient temperature, heating also serves to maintain a building's structural, mechanical, and electrical systems.

Radiant heating systems usually employ either hot-water pipes embedded in the floor or ceiling of a structure, warm-air ducts embedded in the floor, or some form of electrical resistance panels applied to ceilings or walls. Panel heating is a form of radiant heating characterized by very large radiant surfaces maintained at modestly warm temperatures. With many such systems there is no visible heating equipment within the structure, which is an advantage in decorating. A disadvantage is the extent to which a ceiling or floor might be ruined in case of corroded or faulty hot-water piping where this method is employed.

To overcome these and other deficiencies inherent with such radiant heating systems, the prior art has devised low intensity radiant heating systems of the infrared variety (hereinafter referred to as "infrared heaters"). Infrared heaters typically employ burners which ignite combustible gas within a tube. The tube becomes heated and emits the heat in the form of radiant energy into a surrounding space or area. This is contrast to high-intensity infrared heating devices characterized by open flames and glowing hot ceramic surfaces which emit radiant energy into the space.

Low intensity infrared heaters are provided in basically three mechanical varieties, and have been classified by the American Society of Heating, Refrigeration, and Air-Conditioning Engineers (ASHRAE) as Type 1a, Type 1b, and Type 1c. Type 1a infrared heaters, which normally include only single burner systems, involve atmospheric burners which utilize the natural buoyancy of hot combustion gases to draw combustion air into a burner mechanism. Type 1b infrared heaters use a mechanical assist fan at a flue end of a heater tubing system to draw combustion air into a burner mechanism. These types of systems can have single or multiple burner mechanisms within the same tubing system, and generally provide the longest heat exchanger lengths. Finally, Type 1c heaters, sometimes referred to as unitary heaters, use a mechanical assist fan at a burner end of a heater tubing to force combustion air into a burner mechanism. Type 1c heaters typically employ a single burner mechanism with minimal lengths of heat exchanger tubing.

While the number of manufacturers offering Type 1a, Type 1b, and Type 1c heaters have increased over the years, the basic operational performance and concepts associated with the devices has remained remarkably constant. Burners of the Type 1a category are typically of a venturi design, mixing air and gas partially within a venturi section prior to ignition. Burners of the Type 1c category are typically of a nozzle mix design, mixing air and gas partially within a burner throat before ignition. Burners of the Type 1b category are typically of a pre-mix configuration, mixing air and gas as completely as possible before ignition. This is particularly critical in multiple burner systems, as better mixing is required to avoid difficulties of combustion contamination at downstream burner locations.

The current state of the art technology in the industry relative to multiple burner systems is best illustrated in the product named Co-Ray-Vac® from Roberts-Gordon, Inc., in Buffalo, N.Y., or in a derivative product called No-Ray-Vac® from AmbiRad LTD in the United Kingdom. These products have existed since about 1962. Each system consists of multiple burners (usually four to six in line for smaller firing rates, and two to three in line for larger firing rates) operating in series relative one another along a length of radiant tubing. Systems for these products are designed based on overall flow volume relationships and capacity of a vacuum which provides negative pressure on the entire network of tubing. Tubing lengths vary according to selected heating requirements and desired thermal efficiency, with longer lengths of tubing providing higher thermal efficiency and a wider heating distribution area.

A typical multiple burner system is comprised of a plurality of gas burners mounted in series along a length of a tube. Each burner is equipped with fuel and air orifices in proportion required for acceptable combustion. A vacuum pump at an end of the system establishes a negative pressure at each burner which determines the fuel and airflow rate through each burner, and also draws combusted gases to an outlet for proper emission of combusted gases. In such a system, the vacuum pump is set at one predetermined vacuum setting, with the output of the system being alterable by varying the fuel and air orifices in each burner.

Because of the large amount of attached heating tubes, this type of multiple burner system costs substantially more to the user than heaters of the Type 1c designation. Because of this, and because of the industry market pressures brought to bear by an ever increasing number of manufacturers of the less expensive unitary type heater system, designers are faced with a serious dilemma. Longer heat exchangers, which provide superior performance and heating distribution and efficiency, are increasingly more expensive to install, while unitary heaters are less expensive to install, but do not provide the desired performance capabilities.

In an attempt to ease this dilemma, manufacturers of the multiple burner systems have made burner firing rates larger in an attempt to provide more heating capacity at lower first user costs. Additionally, manufacturers routinely recommend that minimal heat exchanger lengths be installed to save money. These attempts give in to the design dilemma stated above by sacrificing performance for the benefit of first cost.

Physical laws of fluid flow dictate that for a given vacuum pump setting, each burner in a multiple burner system experiences a different vacuum level. In other words, the negative pressure differential or vacuum experienced by a burner closer to the vacuum pump is greater than the negative pressure differential or vacuum experienced by a burner further from the vacuum pump. Therefore, with current technology, burners closest to the vacuum pump burn at higher thermal output rates than burners furthest from the vacuum pump, which burn at lower thermal output rates. Where all of the burners in a multiple burner system are rated at a given firing rate or output, only the intermediate burners operates at a nominal rate, which is the most efficient rate of burning. Accordingly, manufacturers are less likely to develop larger burner systems because the larger the burner, the more difficult it becomes to achieve clear and complete combustion at downstream locations. In sum, the ever increasing vacuum or negative pressure differential along the length of the tube of a system toward the vacuum pump results in burners nearer the pump operating at rates far beyond their nominal design output. This phenomena results in unacceptable combustion conditions, which in turn limits burner size.

With respect to the aforementioned Roberts-Gordon Co-Ray-Vac® system, which is constructed with fixed gas and air metering devices which must also function as flow metering devices, the change in vacuum assist levels not only varies the firing rate, but it also varies the fuel-air ratio, or the relationship of air and gas on a volumetric level. Because the relative size of the gas metering orifice is small as compared to the air metering orifice, the variation of vacuum changes the relative proportions of flow of gas or air to the burner. This contributes to poorer combustion at high vacuum levels. The downstream combustion problem is further compounded because there is a unique set of fixed gas and air metering devices for each firing rate, making systems with multiple firing rate burners hard to adjust or control. In sum, the prior art burners have defined orifices for a balanced fuel and air mixture which relates to a closely defined vacuum setting. As vacuum settings increase away from the defined vacuum setting, the ratio of fuel and air becomes increasingly unbalanced, further contributing to the limitation of incorporating more and larger burners in series while still maintaining complete and efficient burn outputs.

Due to the inherent fault in current technology that provides for a large firing rate inconsistency in a series of burners, large amounts of dilution air are brought into the system at the first burner to smooth out the inconsistency, and to even out the heat along the length of the tubing network. The cooling effect of this air decreases the operating efficiency of the first burner in line, and uses up precious vacuum fan volumetric capacity that could be more efficiently utilized with additional firing rate capacity.

DISCLOSURE OF THE INVENTION

It would be highly advantageous, therefore, to remedy the foregoing and other deficiencies inherent in the prior art.

Accordingly, it is an object of the present invention to provide a new and improved radiant heating system.

Another object of the present invention is to provide a new and improved burner assembly for use in a radiant heating system.

And another object of the present invention is to provide a burner assembly for operating at a nominal firing rate under varying vacuum or negative pressure conditions.

Still another object of the present invention is to provide a radiant heating system that is efficient.

Yet another object of the present invention is to provide a burner assembly that is easily and selectively adjustable for ensuring an efficient firing or burn rate under varying negative pressure conditions.

Yet still another object of the present invention is to provide a metering element for regulating the mixing of air and gas within a burner assembly and for regulating the flow of combustible gas through the burner assembly at varying vacuum or negative pressure conditions.

A further object of the present invention is to provide a metering element that may be easily used in combination with existing technology.

Another object of the present invention is the provision of reducing combustion emissions such as carbon monoxide and nitrous oxide.

And another object of the present invention is the provision of larger firing rate burner assemblies.

Still another object of the present invention is to provide a radiant heating system that conserves energy.

Yet another object of the instant invention is to provide a radiant heating system having the capacity for utilizing an extremely high number of individual burner assemblies connected in series.

Briefly, to achieve the desired objects of the present invention in accordance with a preferred embodiment thereof, provided is a radiant heating system for providing radiant heat to an area. The radiant heating system includes a tube for radiating heat, the tube having a downstream end and an upstream end. Further provided are a plurality of burner assemblies mounted in series along a length of the tube, each of the burner assemblies for igniting a combustible gas within the tube. The radiant heating system further includes a vacuum pump mounted proximate the upstream end for supplying negative pressure within the tube, and a metering located suitably located within each of the burner assemblies for controlling the firing rate of the each of the burner assemblies under variable negative pressure conditions.

Further provided is a burner assembly for a radiant heater, the radiant heater including a tube for radiating heat provided from the burner assembly and a vacuum pump for introducing negative pressure within the tube. The burner assembly includes a gas inlet, an air inlet, a mixing chamber for mixing fuel gas received from the gas inlet with air received from the air inlet to form a combustible gas. The burner assembly further includes a combustion assembly for receiving the combustible gas from the mixing chamber, and for igniting the combustible gas within the tube. Also included is a metering element carried by within the mixing chamber for selectively regulating the mixing of the air and the fuel gas, and for further regulating the flow of the combustible gas to the combustion assembly. The mixing chamber may be replaced with a metering chamber for mixing fuel gas received from the gas inlet with air received from the air inlet to form the combustible gas. The mixing chamber includes a metering element that may be selectively adjusted for regulating the mixing of the air and the fuel gas, and for regulating the flow of the combustible gas to the combustion assembly.

The instant invention also includes a method of heating comprising the steps of providing a tube for radiating heat, providing a plurality of burner assemblies each having a firing rate, and mounting said burner assemblies in series along a length of the tube. The burner assemblies are operative for igniting a combustible gas proximate a combustion assembly suitably located within the tube. The method further includes the steps of introducing negative pressure within the tube, and controlling the firing rate of each of the burner assemblies for maintaining each burner assembly proximate a nominal firing rate.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings, in which.

BEST MODES FOR CARRYING OUT THE INVENTION

Figures 1, 2:
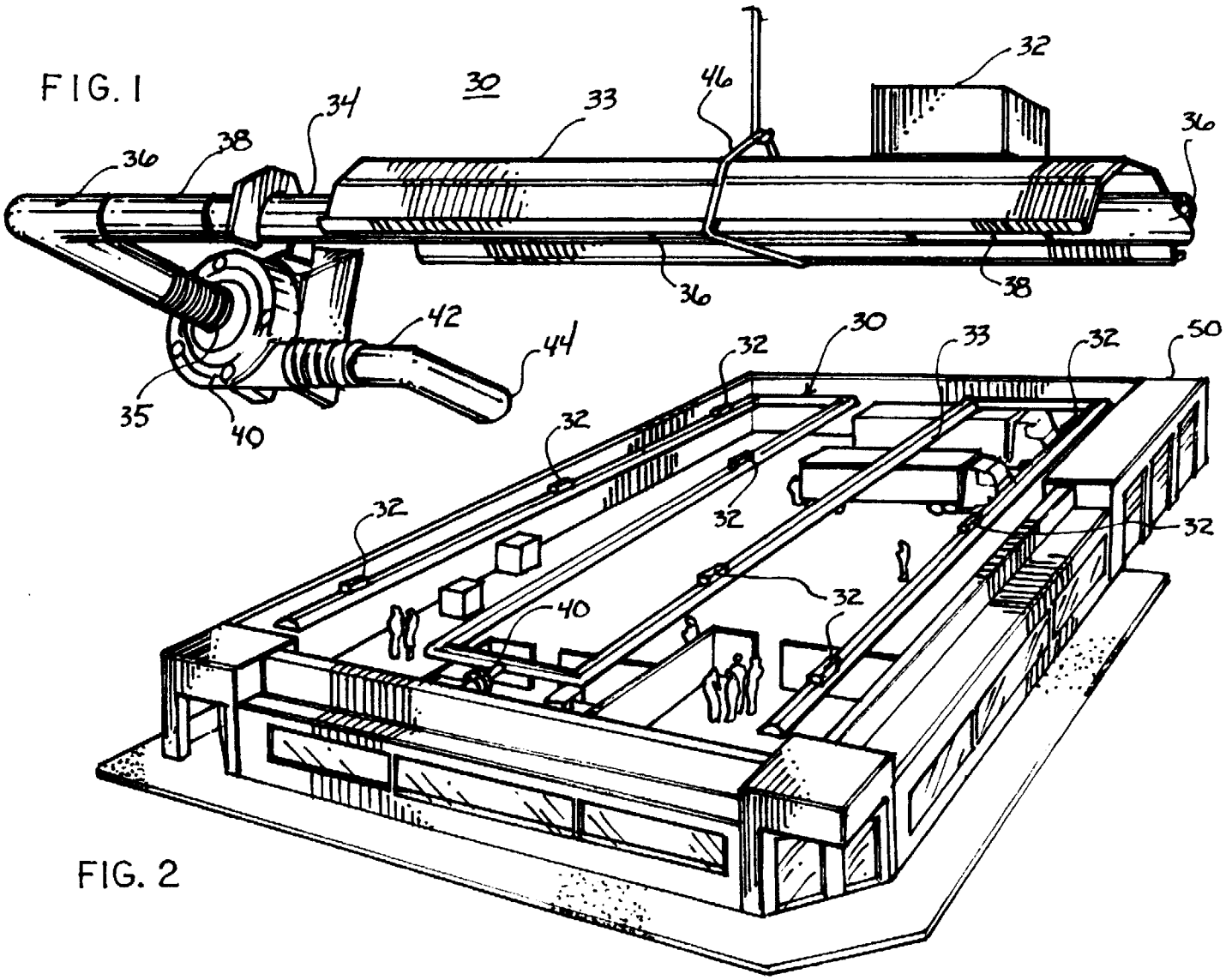
FIG. 1 is a perspective view illustrating portions of a low intensity infrared heating system.
FIG. 2 is a perspective view of a low intensity heating system as it would appear utilized in combination with a structure.

Turning now to the drawings in which like reference characters indicate corresponding elements throughout the several views, attention is first directed to FIG. 1 which illustrates a heating system being generally designated by the reference character 30. Heating system 30 is of the infra-red type typically used for emitting heat in the form of radiant energy into an area to be heated.

As can be seen in FIG. 1, heating system 30 includes a burner assembly 32 carried upon portions of a reflector element 33. Although only one burner assembly is shown for purposes of illustration, it will be readily understood that a plurality of burner assemblies may be used as selectively desired for use in a larger heating system. The reflector element 33, having a generally inverted U-shaped configuration, partially encompasses tube 34 and functions as a means for directing the radiant energy or heat from tube 34 into a selected area. Tube 34, having a substantially elongate configuration, an upstream end 35, and a downstream end (not herein specifically shown) is comprised of a plurality of tube elements 36 each of which are coupled together by means of wrap around couplings 38. As will be further discussed, burner assembly 32 is operative for igniting a combustible gas within tube 34 for providing heat to tube 34. The tube 34 absorbs the heat provided from the burner assembly 32 and emits or radiates the heat therefrom for providing heat to a selected area, with the reflector element 33 being operative for maximizing the reflection of the radiant energy emitted by the tube 34 to the selected area. The heating system 30 further includes a vacuum pump 40 coupled upstream end 35 of tube 34 which is operative for providing a negative pressure atmosphere within tube 34 which draws fuel gas and air through burner assembly 32 and which further draws the heat provided from burner assembly 32 through tube 34, further details of which will be herein further discussed. Additionally, the vacuum pump 40 includes an exhaust pipe 42 having an exhaust outlet 44 for emitting combusted gases or by-products produced from the combustion taking place within tube 34 to the outdoor atmosphere.

Heating system 30 may be of any preferred length or configuration, and may be utilized with one burner assembly 32 for providing radiant heat to a relatively small area, or a plurality of burner assemblies for providing radiant heat to a larger area. In typical operation, heating system 30 is normally suspended from a ceiling of a structure by means of hangers, such as hanger 46 illustrated in combination with FIG. 1.

For instance, FIG. 2 illustrates how heating system 30 may be installed in combination with building 50 for providing heat to the building 50 for maintaining the temperature within the building 50 proximate a desired temperature range for providing comfort to the inhabitants therein. Preferably suspended from the ceiling of building 50 (not herein specifically shown), heating system 30 includes a plurality of burner assemblies 32 carried by portions of reflector element 33 and further coupled in series along the length of tube 34 (not herein specifically shown) each for providing heat to tube 34, of which will be further explained as the detailed description ensues. Further shown is vacuum pump 40 operative for introducing negative pressure within tube 34 for drawing the heat provided from each burner assembly 32 through the system.

Heating system 30 as herein discussed is of the type such as the Co-Ray-Vac® low-intensity heating system provided from Roberts-Gordon, Inc., in Buffalo, N.Y., or a derivative product called the No-Ray-Vac continuous radiant tube heating system provided from AmbiRad, LTD, in the United Kingdom. All of the elements and operational features herein discussed in combination with heating system 30 are typical with these above referenced systems, further details of which will not be herein discussed as they will be readily understood by those having ordinary skill in the art.

Figure 3:
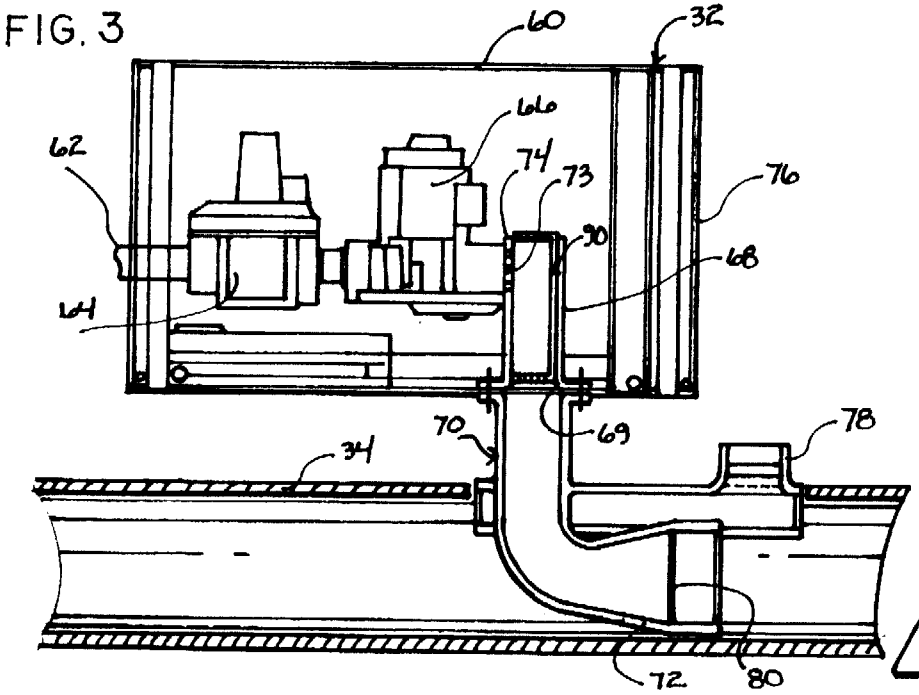
FIG. 3 is a side elevational view of a burner assembly.

Attention is now directed to FIG. 3, which illustrates details of burner assembly 32. Burner assembly 32 is of the type provided in combination with the radiant heating systems provided from Roberts-Gordon, Inc., in Buffalo, N.Y., or AmbiRad, LTD, in the United Kingdom. As can be seen, burner assembly 32 includes a burner housing 60 with a gas inlet 62 extending therein. The gas inlet 62 is in gaseous communication with a zero regulator 64 which is further in gaseous communication with a solenoid assembly 66. The solenoid assembly 66 is further in gaseous communication with mixing chamber 68 by means of an inlet 73 formed through portions of mixing chamber 68. Mixing chamber includes an open lower end 69 coupled in gaseous communication to a combustion assembly 70 having a burner cup 72 housed within tube 34. The mixing chamber 68 further includes an open upper end 74 which is in gaseous communication with an air inlet 76 formed through portions of burner housing 60.

In operation, burner assembly 32 is operative for providing heat to tube 34. In particular, when heating system 30 is actuated, vacuum pump 40 becomes engaged thereby introducing negative pressure within tube 34. As a result of the negative pressure, fuel gas (not herein specifically shown) passes through gas inlet 62 and is drawn into mixing chamber 68 through inlet 73, while air provided from the external environment is drawn through air inlet 76 and into mixing chamber 68 through open upper end 74. The air and the fuel gas, which may be of any preferred type such as propane gas, natural gas, or other suitable ignitable fuel substance having similar burning characteristics, are drawn together into mixing chamber 68 where they become mixed together to form a combustible gas. Further due to the negative pressure provided by vacuum pump 40, the combustible gas is then drawn through open lower end 69 of mixing chamber 68, ignited by means of ignitor element 78 to produce a flame (not herein specifically shown) which is then supported by flame support grid 80 for communicating the flame into tube 34 for heating tube 34, tube 34 being then operative for radiating the heat in the form of radiant energy to an area.

Figure 4:
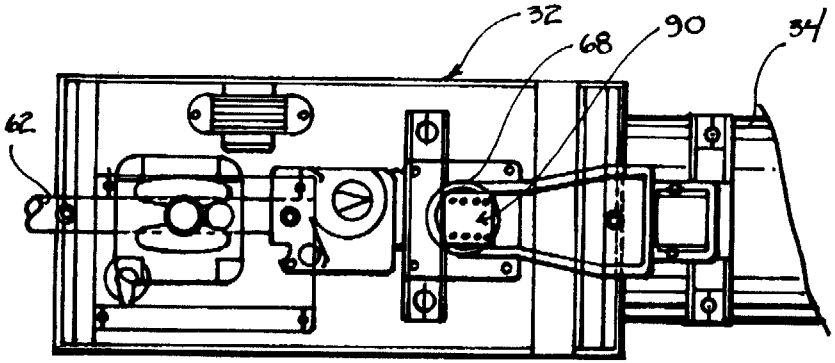
FIG. 4 is a top elevational view of the burner assembly shown in FIG. 3.
Figure 5:
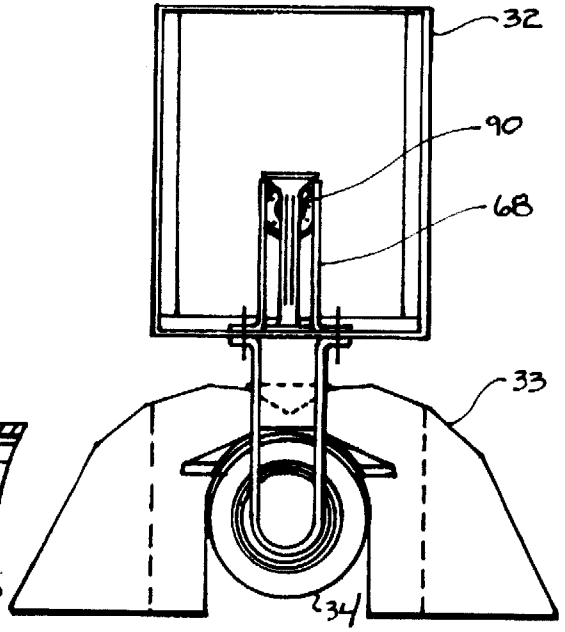
FIG. 5 is a front elevational view of the burner assembly shown in FIG. 4.

With continuing reference to FIG. 3, and additional reference to FIG. 4 and FIG. 5, carried within mixing chamber 68 is seen a metering element 90. The metering element functions as a metering means for regulating or controlling the mixing of the combustible gas and for regulating or controlling the flow of the combustible gas through the open lower end 69 of the mixing chamber 68 for controlling the firing rate of burner assembly 32 proximate the combustion assembly 70 for maintaining a nominal combustion rate within tube 34 proximate the combustion assembly 70 under variable negative pressure conditions. In particular, when a plurality of burner assemblies are coupled in series along the length of tube 34, each burner assembly 32 is exposed to a different negative pressure environment within tube 34. In a further respect, the burner assembly 32 closest to the vacuum pump 40 experiences a high degree of negative pressure, whereas each successive burner assembly 32 disposed in increasingly remote relation relative vacuum pump 40 experience a progressively decreasing level of negative pressure along the length of tube 34. Through the selective regulation of the mixing and the flow of combustible gas into the combustion assembly 70 of each burner assembly 32 with use of metering element 90, the combustion rate of each burner assembly 32 proximate the combustion assembly 70 can be normalized so that each burner assembly 32 is firing at approximately the same thermal output.

Figures 6, 7, 8, 9, 10:
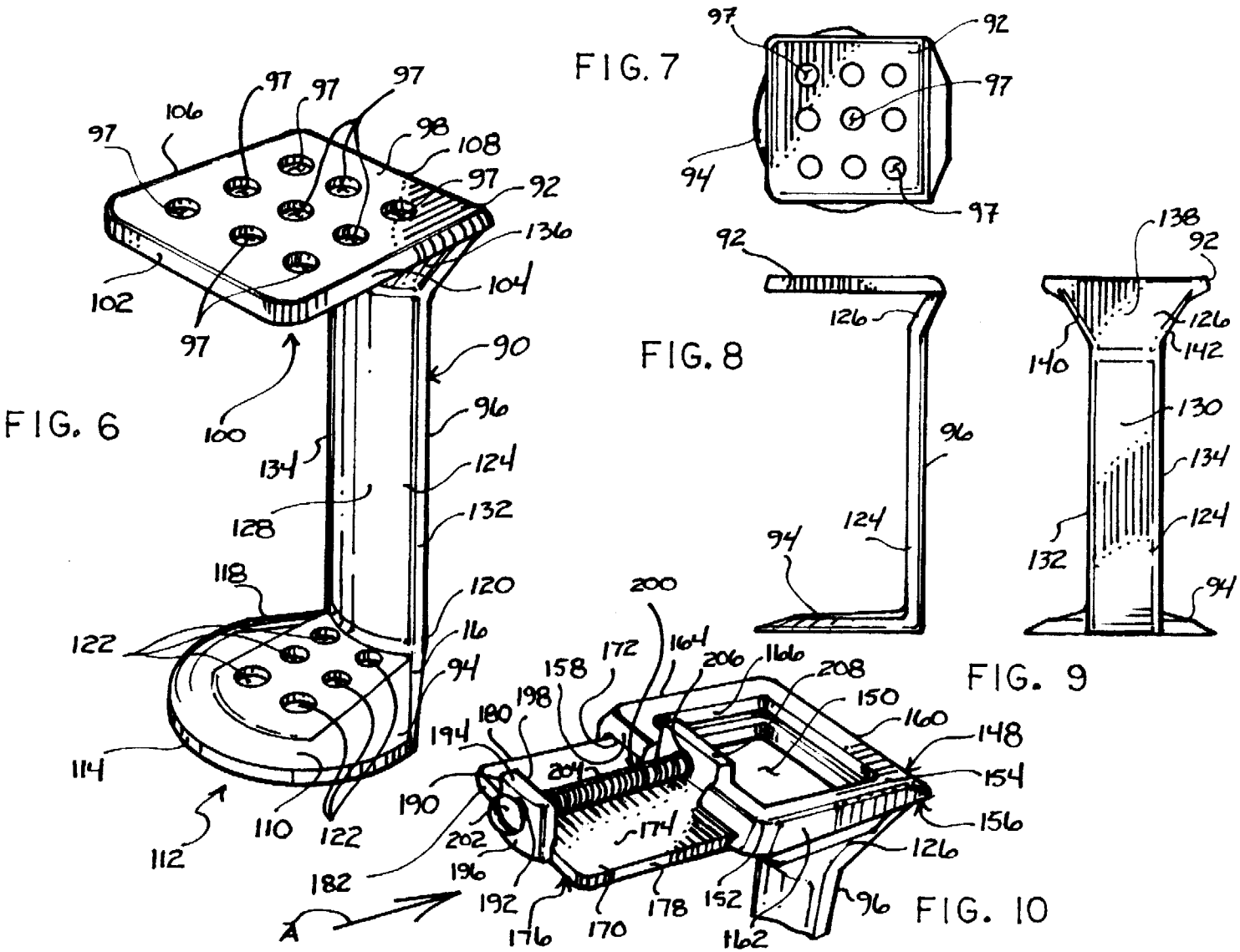
FIG. 6 is an enlarged perspective view of a metering element.
FIG. 7 is a top elevational view of the metering element shown in FIG. 6.
FIG. 8 is a side elevational view of the metering element shown in FIG. 6.
FIG. 9 is a rear elevational view of the metering element shown in FIG. 6.
FIG. 10 is an enlarged fragmentary perspective view of an alternate embodiment of a metering element.

Consistent with the foregoing, attention is now directed to FIG. 6 which illustrates an enlarged view of metering element 90. As can be seen, metering element 90, preferably constructed of stainless steel or other suitable substance, is preferably comprised of a metering plate 92, a choke plate 94 disposed in spaced-apart relation relative metering plate 92 and each defining substantially parallel planes, and a neck 96 disposed therebetween and interconnecting metering plate 92 with choke plate 94. Metering plate 92, further details of which can be seen in combination with FIG. 7 and having a generally square configuration, includes an upper surface 98, a lower surface 100, a front edge 102, two side edges, 104 and 106 respectively, a rear edge 108 from which is integrally attached an upper end of neck 96, and a plurality of apertures 97 formed therethrough. Choke plate includes an upper surface 110, a lower surface 112, a semi-annular leading edge 114, two outwardly divergent side edges, 116 and 118 respectively, extending from a rear edge 120 of which is integrally attached a lower end of neck 96, and a plurality of apertures 122 formed therethrough.

The neck 96, further details of which can be seen in combination with FIG. 8 and FIG. 9, includes a lower neck portion 124 extending upwardly from the choke plate 94, and an upper neck portion 126 extending in an upwardly divergent and rearwardly extending fashion from the lower neck portion 124 and having an upper end integrally attached to rear edge 108 of metering plate 92. The lower neck portion 124, having a generally elongate configuration, includes a front surface 128, a rear surface 130, and side edges, 132 and 134. Upper neck portion 126 includes a front surface 136, a rear surface 138, and two upwardly and outwardly divergent side edges, 140 and 142.

Consistent with FIG. 3, FIG. 4, and FIG. 5, metering element is suitably carried within mixing chamber 68, with metering plate 92 disposed proximate open upper end 74, and choke plate 94 disposed proximate open lower end 69. When heating system 30 is actuated, and air is being drawn into mixing chamber 68, apertures 97 disposed through metering plate 92 function to allow only a predetermined volume of air to pass therethrough and into mixing chamber 68, while apertures 122 proximate the choke plate 94 allow only a predetermined volume of combustible gas to pass therethrough and into the combustion assembly 70 for ignition. Apertures 97 and apertures 122 are selectively configurable for controlling flow rate. In particular, apertures 97 and apertures 122 may be selectively sized or selectively numbered to allow a predetermined and selected amount of air and combustible gas, respectively, to pass therethrough as selectively desired. For burner assemblies that experience large amounts of negative pressure, apertures 97 and apertures 122 may be selectively sized or numbered for allowing a smaller volume of air and combustible gas, respectively, to pass therethrough, whereas for burner assemblies located at increasing remote locations from vacuum pump 40 which in turn experience increasingly smaller levels of negative pressure, apertures 97 and apertures 122 may be selectively sized or numbered for allowing a larger volume of air and combustible gas to pass therethrough. As such, the firing rate of each burner assembly 32 may be selectively controlled so that each fire at a nominal rate.

In further respect, the volume of air introduced into each mixing chamber 68 of each burner assembly 32 disposed in series along the length of tube 34 can be selectively regulated for regulating the burn or firing rates of each burner assembly proximate combustion assembly 70. In other words, the more air flow into the mixing chamber 68, the larger the firing rate the combustion assembly 70. As such, the ratio of air to fuel gas to form the combustible gas can be effectively and easily controlled for providing each burner assembly 32 with a proper mix of fuel gas to air relative a specific negative pressure differential or vacuum for allowing burner assembly 32 to operate at a nominal burn rate. Furthermore, the volume of combustible gas introduced into each combustion assembly 70 of each burner assembly 32 disposed in series along the length of tube 34 can be selectively regulated or controlled for regulating the burn or firing rates of each burner assembly. In other words, the lower the volume of combustible gas introduced into combustion assembly 70, the lower the firing or output rate, while the higher the volume of combustible gas introduced into the combustion assembly 70, the higher the firing or output rate.

Instead of using apertures 97 and apertures 122 as a means for regulating the passage of air into the mixing chamber 68, and for regulating the passage of combustible gas from the mixing chamber into the combustion assembly 70, respectively, FIG. 10 illustrates how an adjustable aperture may be used. As can be seen in FIG. 10, instead of metering plate 92, disclosed is a metering head 148 having a metering aperture 150 selectively adjustable between a first configuration for allowing a maximum volume of air pass therethrough, and a second configuration for allowing a minimum volume of air pass therethrough.

Metering head 148 includes a continuous rim 152 formed in a substantially square configuration. Continuous rim 152 includes an upper surface 154, a lower surface 156, a front edge 158, a rear edge 160, two side edges, 162 and 164, and a continuous inner surface 166 which defines metering aperture 150. Further included is a plate element 170 slidably disposed in an elongate slot 172 formed through portions of front edge 158. Plate element 170 can be seen as having a substantially planar upper surface 174, a substantially planar lower surface 176, two side edges, 178 and 180, a rear edge 182, and a front edge (not herein specifically shown) extending inwardly through elongate slot 172 and proximate metering aperture 150.

Plate element 170 may be selectively and slidably disposed from the first configuration where metering aperture 150 is largest for allowing a large volume of air to pass therethrough, and inwardly in the direction indicated by the arrowed line A for selectively varying the size of metering aperture 150 until metering aperture is eventually closed in the second configuration for allowing only a minimum volume of air to pass therethrough, which would be negligible. As a suitable means for adjusting plate element 170, provided an attachment 190 extending upwardly from rear edge 182 and having an aperture 192 formed therethrough, an upper end 194, an outer surface 196 and an inner surface 198. Rotatably carried within aperture 192 is a screw 200 having a headed end 202 disposed proximate outer surface 196 of attachment 190, an elongate threaded portion 204, and a free end (not herein specifically shown) threadably received by a threaded aperture 206 formed through a flange 208 extending upwardly from portions of upper surface 154 of continuous rim 152 proximate front edge 158.

In operation, plate element 170 may be selectively slid or disposed into metering aperture 150 by rotating screw 200 in the appropriate direction thereby urging plate element 170 into metering aperture 150 for selectively varying the size of metering aperture 150. When slide, side edges 178 and 180 of plate element ride and reside within portions of a groove 210 formed within portions of continuous inner surface 166 of continuous rim 152. Thus, metering aperture 150 is selectively adjustable between the first configuration as shown in FIG. 10 for allowing a maximum volume of air to pass therethrough, and the second configuration (not herein specifically shown) for allowing a minimum amount of air to pass therethrough as has been herein intimated, in the second configuration, the plate element 170 would completely obstruct metering aperture 150 thereby allowing a minimum volume or little or no air to pass therethrough. Between the first configuration and the second configuration, plate element 170 may be selectively positioned for adjusting metering aperture 150 to be of a selected and desired size for allowing a selected volume of air to pass therethrough depending on the varying negative pressure conditions present, details of which have been herein previously discussed.

Although not herein specifically shown, an adjustable aperture as discussed above may similarly be used in combination with the choke plate as selectively desired.

Figure 12:
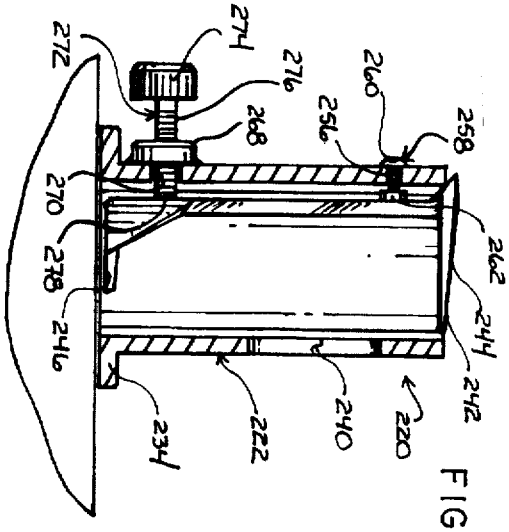
FIG. 12 is a side elevational view of the metering chamber shown in FIG. 11.
Figure 11:
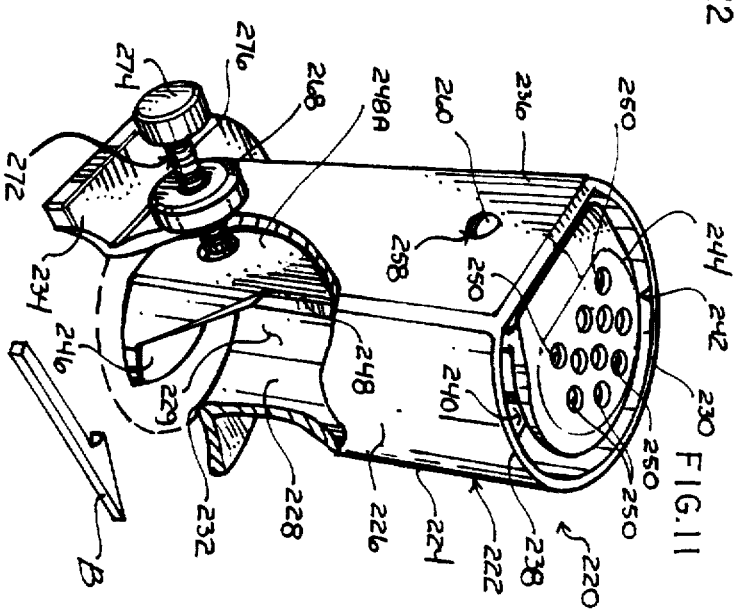
FIG. 11 is an enlarged perspective view of a metering chamber, with portions therein broken away for the purpose of illustration.

Attention is now directed to FIG. 11 and FIG. 12, which illustrate an embodiment of a metering chamber usable in combination with a selected burner assembly 32, the metering chamber being generally designated by the reference character 220. In this embodiment, metering chamber 120 would take the place of mixing chamber 68 illustrated in combination with FIG. 3, FIG. 4, and FIG. 5. In this embodiment, metering chamber 220 includes a conduit 222 having a continuous sidewall 224 with an continuous outer surface 226, a continuous inner surface 228 defining a bore 229, an open upper end 230, and an open lower end 232 having an outwardly extending annular flange 234 for coupling proximate portions of burner assembly 32, details of which will not be herein specifically discussed. As can be seen in FIG. 11, continuous sidewall 224 is composed of a generally planar sidewall section 236, and a generally annular sidewall section 238.

Like mixing chamber 68 previously discussed and being preferably constructed of stainless steel or other suitable material, conduit 222, which may have been of any preferred shape or configuration, is operative for receiving air through open upper end 230 and fuel gas through inlet 240 from a gas inlet (not herein specifically shown), inlet 240 shown as extending through portions of the annular sidewall section 238 of continuous sidewall 224. Carried within bore 229 is seen a metering element 242 and having the same general structural characteristics as metering element 90 discussed in combination with FIG. 6, FIG. 7, FIG. 8, and FIG. 9.

Like metering element 90, metering element 242 includes a metering plate 244 positioned proximate open upper end 230, a choke plate 246 in spaced apart relation relative metering plate 244 and positioned proximate open lower end 232, and a neck 248 interconnecting metering plate 244 with choke plate 246, the metering plate 244 and the choke plate 246 defining substantially parallel planes. Metering plate 244 can be seen as further including a plurality of apertures 250 formed therethrough that may be selectively sized or numbered for allowing a selected volume of air pass therethrough and into bore 229 as selectively desired for controlling the mixing of air and fuel gas, details of which have been herein previously discussed. Unlike choke plate 94 discussed in combination with metering element 90, choke plate 246 is a solid piece having no apertures extending therethrough. However, it will be readily appreciated that choke plate 246 may be formed with apertures if desired for controlling the flow of combustible gas through the open lower end 232.

With continuing reference to FIG. 11, and further reference to FIG. 12, metering element 242 may be selectively disposed between a first configuration and a second configuration, to be herein discussed. One such preferably means of carrying out this function is by pivotally mounting metering element 242 within bore 229 of conduit 222. In particular, extending through a first threaded aperture 256 formed through portions of planar sidewall section 236 proximate open upper end 230 of conduit 222 is a screw 258 having a headed end 260 and a free end (not herein specifically shown) threadably coupled to a pivot mount 262 carried by portions of neck 248. Furthermore, extending first through a spacer element 268 positioned proximate portions of the continuous outer surface 226 of planar sidewall section 236 of conduit 222 proximate open lower end 232, and then through a second threaded aperture 270 formed through portions of planar sidewall section 236 proximate open lower end 232 of conduit 222 is an adjustment screw 272 having a knob 274, an elongate threaded member 276 extending outwardly therefrom and terminating with a free end 278. Free end 278 bears against an outer surface 248A of neck 248.

As has been herein intimated, apertures 250 may be selectively sized or numbered for allowing a desired volume of air pass into bore 229 of conduit 222. As fuel gas passes through inlet 240, and air passes through the open upper end 230 through the apertures 250 formed through metering plate 244, the air and the fuel gas mix together in bore 229 and then pass or expel from bore 229 through open lower end 232, with the choke plate 246 being operative for regulating the volume of combustible gas passing therefrom.

To adjust metering chamber 220, adjustment screw 272 may be selectively and manually rotated by grasping adjustment screw 272 and rotating in the appropriate direction for urging free end 278 against outer surface 248A of neck 248 for pivoting the metering element in the direction indicated by arrow B in FIG. 11. As such, the metering element 242 may be selectively adjusted by pivoting the metering element 242 from a first configuration of which can be seen in FIG. 11 and FIG. 12 for allowing a minimum volume of air to pass through open upper end 230, and a second configuration for allowing a maximum volume of air to pass through open upper end 230 (not herein specifically shown), the metering element 242 being pivotable about pivot mount 262. In the first configuration, it can be seen that metering plate 242 substantially encompasses open upper end 230, with the volume of air passing therethrough into bore 229 being limited by the selective size and number of apertures 250. In the second configuration, metering element 242 may be pivotally urged in the direction indicated by arrow B in FIG. 11 such that metering plate 244 becomes angled apart from open upper end 230 thereby allowing a maximum volume of air to pass therethrough and into bore 229. The metering element 242 may be displaced at any desired position intermediate the first configuration and the second configuration as selectively desired for regulating the volume of air passing into bore 229, and for selectively regulating the passage of combustible gas through open lower end 232 as needed with respect to the varying negative pressure conditions existent along the length of a selected heating system such as heating system 30.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

It is claimed:

1. What is claimed is a radiant heating system comprising:

a tube for radiating heat, said tube having a downstream end and an upstream end;

a plurality of burner assemblies mounted in series along a length of said tube, each of said burner assemblies for igniting a combustible gas within said tube, each burner assembly including a mixing chamber for mixing fuel gas received from a gas inlet, with air received from an air inlet to form a combustible gas, each burner assembly including a combustion assembly for receiving said combustible gas from said mixing chamber, and for igniting said combustible gas within said tube;

a vacuum pump mounted proximate said upstream end for supplying negative pressure within said tube; and metering means in the form of a metering element, carried by said mixing chamber, for selectively regulating the mixing of the air and the fuel gas, and for further regulating the flow of said combustible gas to said combustion assembly, said metering element also for mixing the combustible gas and for controlling the flow of said combustible gas through each of said burner assemblies for maintaining each burner assembly at substantially the same nominal combustion rate within said tube under variable negative pressure conditions.

2. The radiant heating system of claim 1, wherein each of said burner assemblies includes a mixing chamber having:

an inlet for receiving fuel gas;

an open upper end for receiving air, said mixing chamber for mixing the fuel gas and the air to form said combustible gas; and an open lower end for expelling said combustible gas to be ignited within said tube.

3. The radiant heating system of claim 2, wherein said metering means includes a metering plate, positioned proximate said open upper end of said mixing chamber, for regulating the passage of air through said open upper end.

4. The radiant heating system of claim 3, wherein said metering plate includes a plurality of apertures formed therethrough, each of said apertures selectively sized for allowing a predetermined volume of air to pass therethrough.

5. The radiant heating system of claim 3, wherein said metering plate includes an aperture selectively adjustable between a first position for passing a maximum volume of air therethrough, and a second position for passing a minimum volume of air therethrough.

6. The radiant heating system of claim 2 or 3, wherein said metering means further includes a choke plate, positioned proximate said open lower end of said mixing chamber, for regulating the passage of combustible gas through said open lower end.

7. The radiant heating system of claim 6, wherein said choke plate includes a plurality of apertures formed therethrough, each of said apertures selectively sized for allowing a predetermined volume of combustible gas to pass therethrough.

8. What is claimed is a burner assembly for radiant heater, said radiant heater including a tube for radiating heat provided from said burner assembly and a vacuum pump for introducing negative pressure within said tube, said burner assembly comprising:

a gas inlet;

an air inlet;

a mixing chamber for mixing fuel gas received from said gas inlet with air received from said air inlet to form a combustible gas;

a combustion assembly for receiving said combustible gas from said mixing chamber, and for igniting said combustible gas within said tube; and a metering element carried by said mixing chamber, for selectively regulating the mixing of the air and the fuel gas, and for further regulating the flow of said combustible gas to said combustion assembly, the metering element also controlling the flow of said combustible gas through said burner assembly for maintaining a nominal combustion rate within said tube, under variable negative pressure conditions.

9. The burner assembly of claim 8, wherein said mixing chamber includes:

an inlet for receiving said fuel gas;

an open upper end for receiving air, said mixing chamber for mixing the fuel gas and the air to form said combustible gas; and an open lower end for expelling said combustible gas to be ignited within said tube.

10. The burner assembly of claim 9, wherein said metering element includes a metering plate, positioned proximate said open upper end of said mixing chamber, for regulating the passage of air through said open upper end.

11. The burner assembly of claim 10, wherein said metering plate includes a plurality of apertures formed therethrough, each of said apertures selectively sized for allowing a predetermined volume of air to pass therethrough.

12. The burner assembly of claim 10, wherein said metering plate includes an aperture selectively adjustable between a first position for passing a maximum volume of air therethrough, and a second position for passing a minimum volume of air therethrough.

13. The burner assembly of claim 9 or 10, wherein said metering element further includes a choke plate, positioned proximate said open lower end of said mixing chamber, for regulating the passage of combustible gas through said open lower end.

14. The burner assembly of claim 13, wherein said choke plate includes a plurality of apertures formed therethrough, each of said apertures selectively sized for allowing a predetermined volume of combustible gas to pass therethrough.

15. What is claimed is a burner assembly for a radiant heater, said radiant heater including a tube for radiating heat provided from said burner assembly and a vacuum pump for introducing negative pressure within said tube, said burner assembly comprising:

a gas inlet;

an air inlet; and a metering chamber for mixing fuel gas received from said gas inlet with air received from said air inlet to form a combustible gas, for selectively regulating the mixing of the air and the fuel gas, and for further regulating the flow of said combustible gas to a combustion assembly, said combustion assembly for igniting said combustible gas within said tube, the metering chamber also controlling the flow of said combustible gas through said burner assembly for maintaining a nominal combustion rate within said tube under variable negative pressure conditions.

16. The burner assembly of claim 15, wherein said metering chamber includes a conduit having:

an inlet for receiving said fuel gas;

an open upper end for receiving air;

an open lower end for expelling said combustible gas to said combustion assembly; and a metering element pivotally housed within said conduit for selectively regulating the passage of air through said open upper end, and for further regulating the passage of said combustible gas through said open lower end, said metering element being pivotally movable between a first configuration for allowing a minimum volume of air pass therethrough said open upper end, and a second configuration for allowing a maximum volume of air to pass therethrough said open upper end.

17. The burner assembly of claim 16, wherein said metering element includes:

a metering plate positioned proximate said upper open end;

a choke plate disposed in spaced apart relation relative said metering plate proximate said open lower end; and a neck interconnecting said metering plate with said choke plate, said metering element being pivotally adjustable between a first position for allowing a minimum volume of air pass through said open upper end, and a second position for allowing a maximum volume of air pass through said open upper end.

18. The burner assembly of claim 17, wherein said metering plate includes a plurality of apertures formed therethrough, each of said apertures selectively sized for allowing a predetermined volume of air to pass therethrough.

19. The burner assembly of claim 17, wherein said metering chamber includes an adjustment screw disposed in cooperative relationship with said conduit and said metering element, said adjustment screw being selectively rotatable for selectively adjusting said metering element between said first configuration and said second configuration.

20. What is claimed is a method of radiant heating comprising the steps of:

providing a tube for radiating heat, said tube having a downstream end and an upstream end;

providing a plurality of burner assemblies, each having a firing rate and mounted in series along a length of said tube, each of said burner assemblies for igniting a combustible gas proximate a combustion assembly suitably located within said tube;

introducing negative pressure within said tube; and;

controlling the firing rate of each of said burner assemblies for maintaining each of said burner assemblies proximate a nominal firing rate.

21. The method of claim 20, wherein said step of controlling the firing rate of each of said burner assemblies includes the step of controlling the flow of combustible gas to said combustion assembly.

22. The method of claim 21, wherein said step of controlling the flow of combustible gas to said combustion assembly further includes the steps of:

controlling the mixing of said combustible gas within a mixing chamber of each of said burner assemblies; and regulating the flow of said combustible gas from said mixing chamber.

23. The method of claim 22, wherein said step of controlling the mixing of said combustible gas further includes the steps of controlling the flow of air into said mixing chamber, the mixing of said air and a fuel gas communicated therein comprising said combustible gas.

24. The method of claim 23, where said step of controlling the flow of air further includes the step of providing a metering plate selectively adjustable for allowing a predetermined volume of air to pass into said mixing chamber through an upper open end.

25. The method of claim 24, wherein said step of providing a metering plate further includes the step of providing said metering plate with a plurality of apertures selectively configurable to allow a selected volume of air pass into said mixing chamber.

26. The method of claim 24, wherein said step of providing a metering plate further includes the step of providing said metering plate with a metering aperture selectively adjustable between a first configuration for passing a maximum volume of air into said mixing chamber, and a second configuration for passing a minimum volume of air into said mixing chamber.

27. The method of claim 22, wherein said step of regulating the flow of said combustible gas from said mixing chamber further includes the step of providing a choke plate selectively adjustable for allowing a predetermined volume of combustible gas to pass into said combustion assembly of each of said burner assemblies through an open lower end to be ignited.

28. The method of claim 27, wherein said step of providing a choke plate further includes the step of providing said choke plate with a plurality of apertures selectively configurable to allow a selected volume of combustible gas to pass therethrough and into said combustion assembly of each of said burner assemblies.

29. A radiant heating system having a plurality of burner assemblies as claimed in claim 15, 16, 17, 18 or 19 comprising:

(a) said tube having a downstream end and an upstream end;

(b) said vacuum pump mounted proximate said upstream end of said tube; and (c) a plurality of said burner assemblies mounted in series along a length of said tube, each of said burner assemblies for igniting a combustible gas within said tube, such that said metering chamber controls the flow of said combustible gas through each of said burner assemblies for maintaining each burner assembly at substantially the same nominal combustion rate within said tube under variable negative pressure conditions.

* * * * *